US009297510B2

(12) United States Patent
Long

(10) Patent No.: US 9,297,510 B2
(45) Date of Patent: Mar. 29, 2016

(54) LED LAMP WITH FIXED FRAME

(71) Applicants: Shenzhen BYD Auto R&D Company Limited, Shenzhen (CN); BYD Company Limited, Shenzhen (CN)

(72) Inventor: Feihong Long, Shenzhen (CN)

(73) Assignees: SHENZHEN BYD AUTO R&D COMPANY LIMITED, Shenzhen, Guangdong (CN); BYD COMPANY LIMITED, Shenzhen, Guangdong (CN)

( * ) Notice: Subject to any disclaimer, the term of this patent is extended or adjusted under 35 U.S.C. 154(b) by 275 days.

(21) Appl. No.: 13/930,470

(22) Filed: Jun. 28, 2013

(65) Prior Publication Data

US 2014/0003064 A1 Jan. 2, 2014

(30) Foreign Application Priority Data

Jun. 28, 2012 (CN) ..... 2012 2 0305850 U
Nov. 12, 2012 (CN) ..... 2012 2 0592748 U

(51) Int. Cl.

| | |
|---|---|
| ***F21K 99/00*** | (2010.01) |
| ***F21V 5/04*** | (2006.01) |
| ***F21V 17/10*** | (2006.01) |
| *F21Y 101/02* | (2006.01) |
| *F21V 29/89* | (2015.01) |
| *F21V 29/00* | (2015.01) |

(52) U.S. Cl.
CPC . *F21V 5/04* (2013.01); *F21K 9/137* (2013.01); *F21K 9/30* (2013.01); *F21V 17/10* (2013.01); *F21V 29/246* (2013.01); *F21V 29/89* (2015.01); *F21Y 2101/02* (2013.01)

(58) Field of Classification Search
CPC ..... F21V 5/04; F21V 17/10; F21K 9/137; F21K 9/30
See application file for complete search history.

(56) References Cited

U.S. PATENT DOCUMENTS

2012/0195053 A1 8/2012 Wu

FOREIGN PATENT DOCUMENTS

| | | | |
|---|---|---|---|
| CN | 202024257 | U | 11/2011 |
| CN | 102378466 | A | 3/2012 |
| WO | 2007128070 | A1 | 11/2007 |

*Primary Examiner* — Joseph L Williams
(74) *Attorney, Agent, or Firm* — David D. Brush; Westman Champlin & Koehler, P.A.

(57) ABSTRACT

An LED lamp is provided. The LED lamp includes a base; a heat radiation member disposed on the base and having a cavity therein; an LED module disposed on a bottom wall of the cavity; and a fixing frame mounted in the cavity so as to press the LED module on the bottom wall of the cavity.

15 Claims, 9 Drawing Sheets

LED LAMP WITH FIXED FRAME

CROSS-REFERENCE TO RELATED APPLICATIONS

This application claims priority and benefits of the following applications:

1) Chinese Patent Application No. 201220592748.1 filed with State Intellectual Property Office, P. R. C. on Nov. 12, 2012; and 2) Chinese Patent Application No. 201220305850.9 filed with State Intellectual Property Office, P. R. C. on Jun. 28, 2012.

The entire contents of the above applications are incorporated herein by reference.

FIELD

Embodiments of the present disclosure generally relate to an LED lamp.

BACKGROUND

A conventional LED lamp generally comprises an LED module and a heat radiation member. A substrate of the LED module is mounted on the heat radiation member via a bolt. However, it is difficult to form a bolt hole in the LED module having a small size, so that the LED module is difficult to mount. Moreover, if the substrate is a ceramic substrate, the ceramic substrate will be broken when forming a bolt hole therein. Therefore, the LED module of the conventional LED lamp is difficult to mount.

SUMMARY

Embodiments of the present disclosure provide an LED lamp, comprising a base; a heat radiation member disposed on the base and defining a cavity therein; an LED module disposed on a bottom wall of the cavity; and a fixing frame mounted in the cavity so as to press the LED module on the bottom wall of the cavity.

With the LED lamp according to embodiments of the present disclosure, the LED module is more easily mounted on the bottom wall of the cavity by disposing the a fixing frame for pressing the LED module on the bottom wall of the cavity. Moreover, because the LED module is mounted without a bolt, the LED module is prevented from breakage. In addition, the heat radiation is facilitated by using the a fixing frame to press the LED module on the bottom wall of the cavity, and therefore the service life of the LED lamp can be prolonged. Thus, the LED lamp according to embodiments of the present disclosure can be easier to assemble and has long service life.

DETAILED DESCRIPTION

Figure 1:
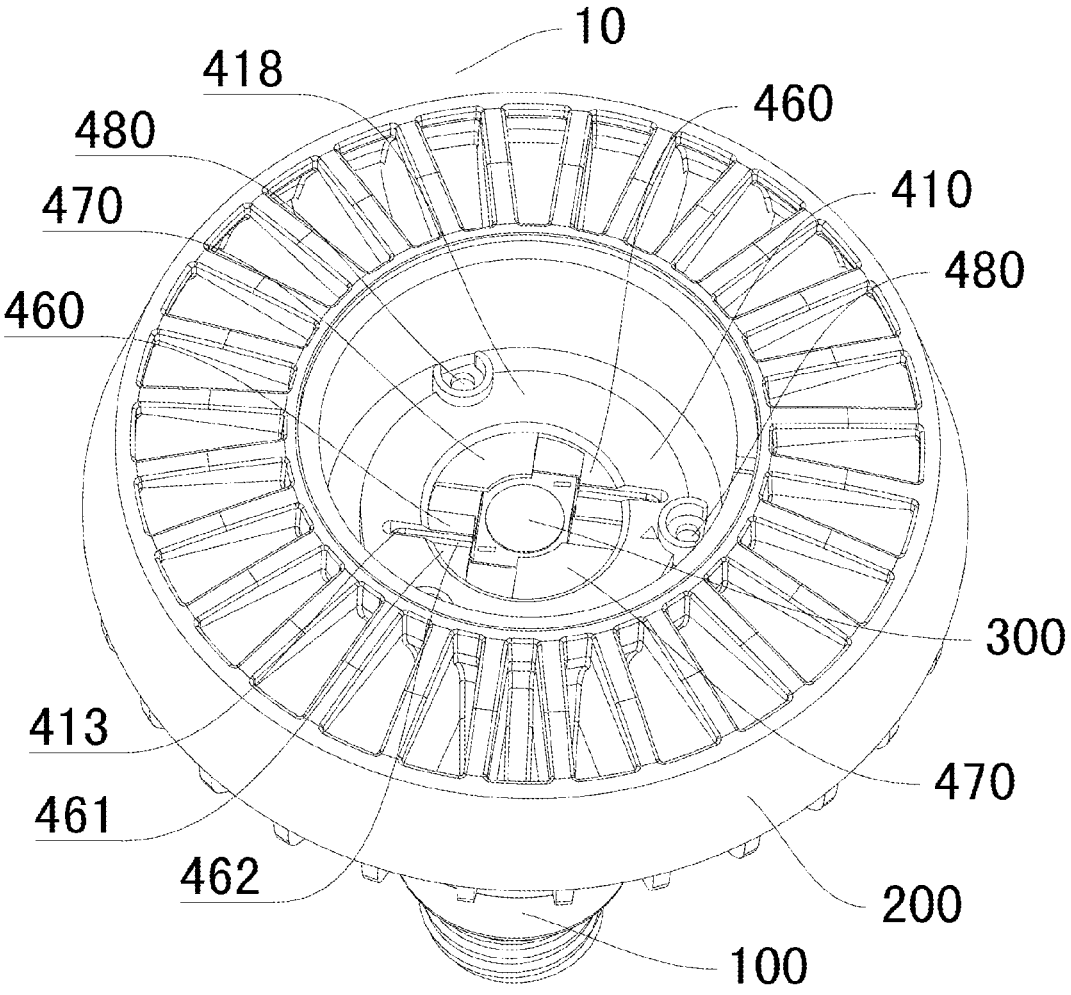
FIG. 1 is a schematic perspective view of an LED lamp according to an embodiment of the present disclosure.

Referring to the drawings, embodiments of the present disclosure will be described by way of example only.

Unless specified or limited otherwise, terms concerning attachments, coupling and the like, such as "mounted," "connected," "supported," and "coupled" and variations thereof are used broadly and encompass both direct and indirect mountings, connections, supports, and couplers. Further, "connected" and "coupled" are not restricted to physical or mechanical connections or couplers.

In the specification, relative terms such as "central", "longitudinal", "lateral", "front", "rear", "right", "left", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

The LED lamp 10 according to embodiments of the present disclosure will be described below with reference to FIGS. 1 to 5. As shown in FIGS. 1 to 5, the LED lamp 10 according to embodiments of the present disclosure comprises a base 100, a heat radiation member 200, an LED module 300 and a fixing frame 400.

The heat radiation member 200 is disposed on the base 100 and has a cavity 210 therein. The LED module 300 is disposed on a bottom wall 213 of the cavity 210. The a fixing frame 400 is mounted in the cavity 210 so as to press the LED module 300 on the bottom wall 213 of the cavity 210. In other words, the LED module 300 is disposed between the a fixing frame 400 and the bottom wall 213 of the cavity 210. That is, the a fixing frame 400 and the bottom wall 213 of the cavity 210 clamp the LED module 300.

With the LED lamp 10 according to embodiments of the present disclosure, the LED module 300 is more easily mounted on the bottom wall 213 of the cavity 210 by disposing the a fixing frame 400 for pressing the LED module 300 on the bottom wall 213 of the cavity 210. Moreover, because the LED module 300 is mounted without a bolt, the LED module 300 is prevented from breakage. In addition, the heat radiation is facilitated by using the a fixing frame 400 to press the LED module 300 on the bottom wall 213 of the cavity 210, and therefore the service life of the LED lamp 10 can be prolonged. Thus, The LED lamp 10 according to embodiments of the present disclosure can be easier to assemble and has long service life.

Figure 2:
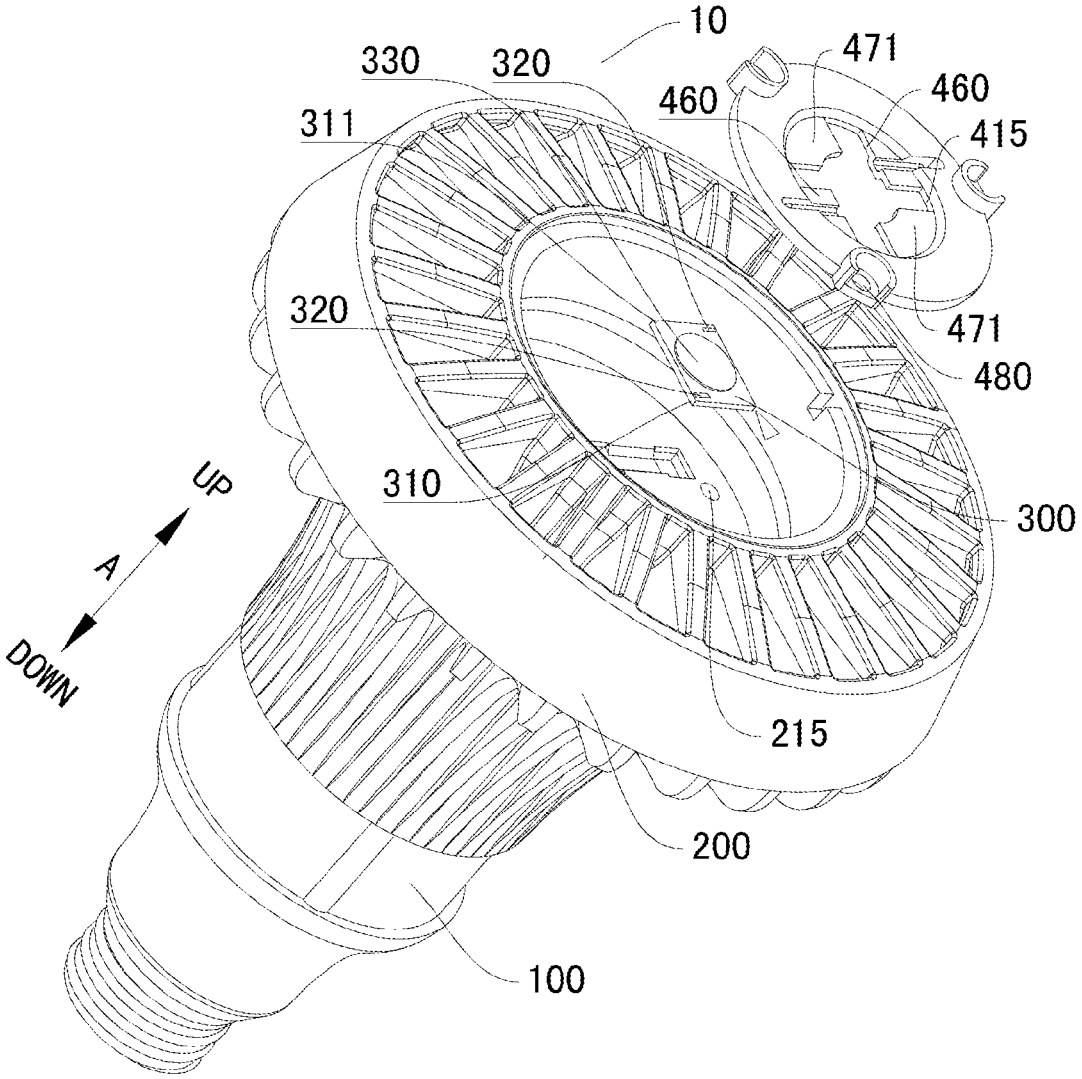
FIG. 2 is an exploded view of an LED lamp according to an embodiment of the present disclosure.

As shown in FIGS. 1 and 2, in some embodiments, the LED module 300 may comprise a substrate 310, a patch board 320, a wire (not shown) and a chip 330. The substrate 310 is pressed on the bottom wall 213 of the cavity 210 by the a fixing frame 400. The patch board 320 is disposed on the substrate 310. The wire is connected with the patch board 320. The chip 330 is disposed on the substrate 310 and electrically connected to the patch board 320. Thus, the LED module 300 is simple in structure.

In some embodiments, the substrate 310 is a ceramic substrate. A person skilled in the art will understand that the ceramic substrate is easy to break. However, in embodiments of the present invention, the ceramic substrate is prevented from breakage by using the a fixing frame 400 to press the ceramic substrate on the bottom wall 213 of the cavity 210.

Figure 3:
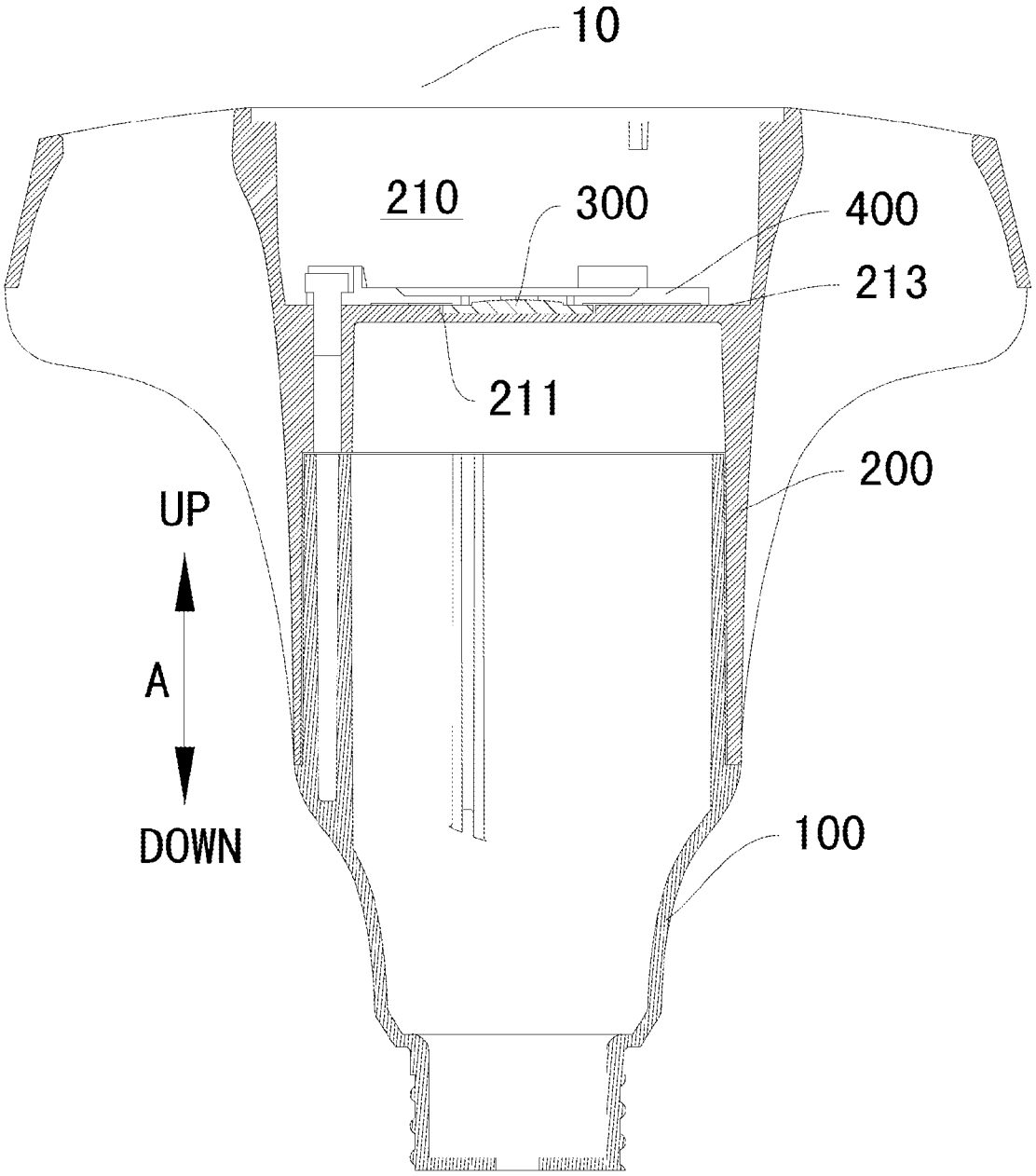
FIG. 3 is a sectional view of an LED lamp according to an embodiment of the present disclosure.

As shown in FIGS. 1 and 3, in some embodiments, the a fixing frame 400 presses an outer edge 311 of the substrate 310. Thus, the a fixing frame 400 does not contact the chip 330. That is, the a fixing frame 400 is mounted in the cavity 210 so as to press the substrate 310 on the bottom wall 213 of the cavity 210. In other words, the a fixing frame 400 and the bottom wall 213 of the cavity 210 clamp the substrate 310, i.e. the substrate 310 is disposed between the a fixing frame 400 and the bottom wall 213 of the cavity 210.

Figure 5:
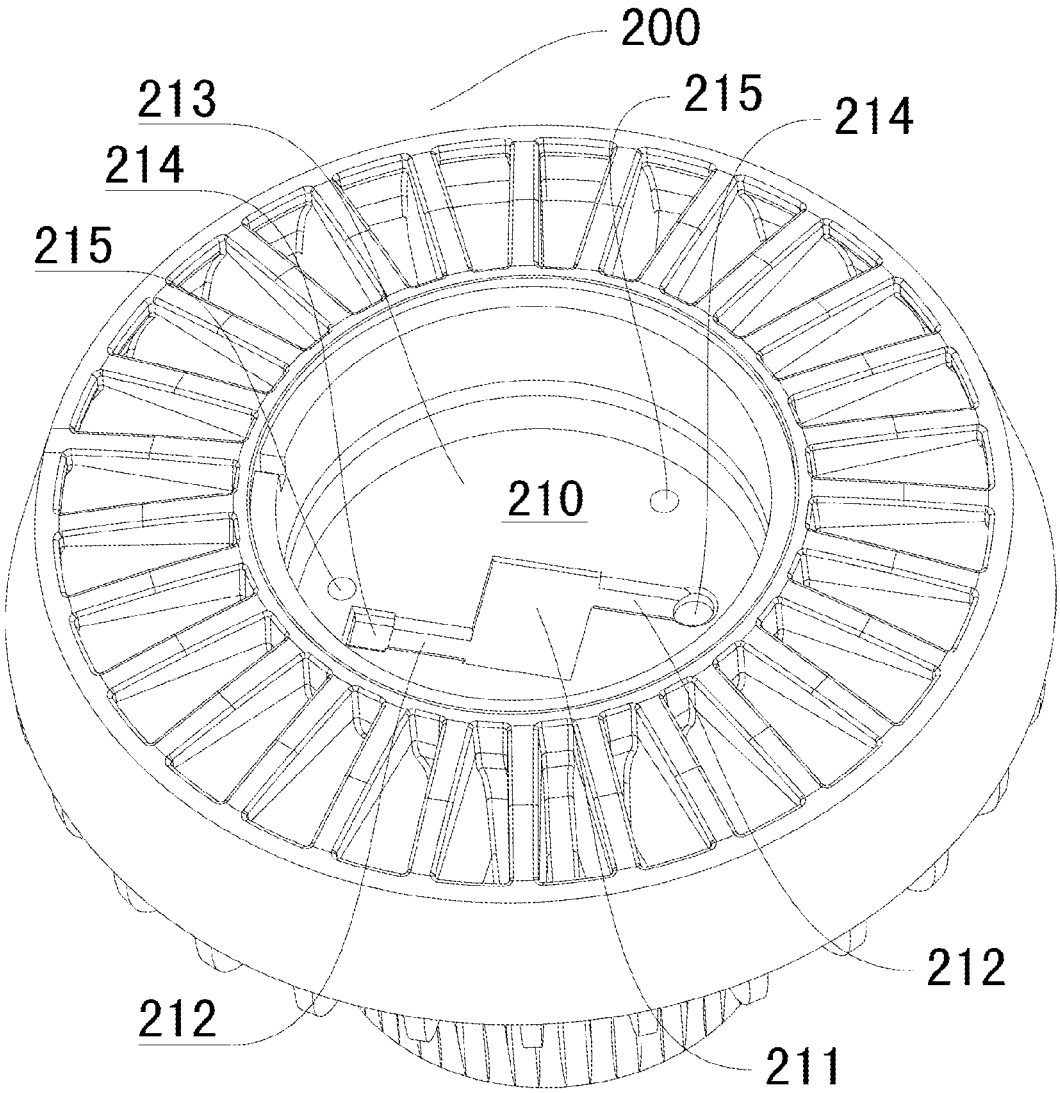
FIG. 5 is a schematic perspective view of a heat radiation member of an LED lamp according to an embodiment of the present disclosure.
Figure 6:
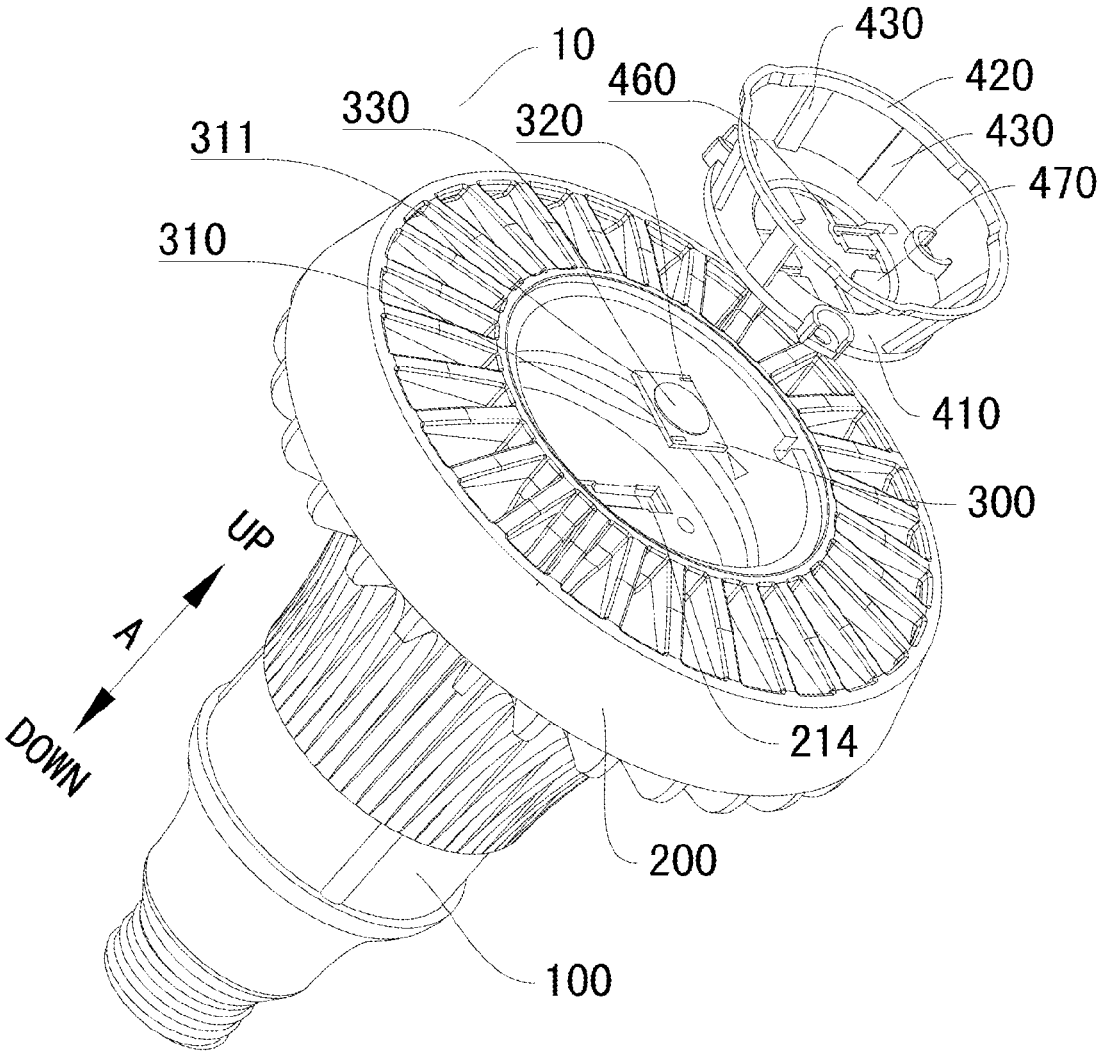
FIG. 6 is an exploded view of an LED lamp according to another embodiment of the present disclosure.

In some embodiments, as shown in FIGS. 3 and 5, a first holding groove 211 is formed in the bottom wall 213 of the cavity 210, and the substrate 310 is disposed in the first holding groove 211. Thus, the LED module 300 can be accurately and expediently mounted on the bottom wall 213 of the cavity 210. In other words, the LED module 300 can be positioned by forming the first holding groove 211 in the bottom wall 213 of the cavity 210.

In some embodiments, a length of the first holding groove 211 may be slightly larger than that of the substrate 310, and a width of the first holding groove 211 may be slightly larger than that of the substrate 310, therefore, the substrate 310 can be expediently disposed in the first holding groove 211. A thickness of the substrate 310 may be larger than a depth of the first holding groove 211. Thus, the a fixing frame 400 is expediently fitted with the bottom wall 213 of the cavity 210 so as to fix the LED module 300 between the a fixing frame 400 and the bottom wall 213 of the cavity 210.

In some embodiments, the a fixing frame 400 is detachably fixed on the bottom wall 213 of the cavity 210 by a fastener such as a bolt. Specifically, a first fixation hole 480 is formed in the a fixing frame 400, a second fixation hole 215 is formed in the bottom wall 213 of the cavity 210, and the fastener is fitted within the first fixation hole 480 and the second fixation hole 215. Both of the first fixation hole 480 and the second fixation hole 215 may be threaded holes. A plurality of first fixation holes 480 and a plurality of second fixation holes 215 may be formed. For example, three first fixation holes 480 and three second fixation holes 215 may be formed.

As shown in FIGS. 1-2, 4, 6 to 9, in some embodiments, the a fixing frame 400 comprises a fixing part 410 and a pressing part 470. The fixing part 410 is mounted on the bottom wall 213 of the cavity 210. The pressing part 470 is connected with the fixing part 410 for pressing the LED module 300. In other words, the pressing part 470 presses the substrate 310 on the bottom wall 213 of the cavity 210. That is, the pressing part 470 and the bottom wall 213 of the cavity 210 clamp the substrate 310, i.e. the substrate 310 is disposed between the pressing part 470 and the bottom wall 213 of the cavity 210. Thus, the a fixing frame 400 is more simple and reasonable in structure. Specifically, the first fixation hole 480 is formed in the fixing part 410.

In some embodiments, as shown in FIGS. 1-2, 4, 6 to 9, the fixing part 410 is configured as an annular plate. The pressing part 470 comprises a plurality of pressing plates 471 extended from an inner wall 415 of the fixing part 410 toward a center of the fixing part 410, spaced apart from each other along a circumferential direction of the fixing part 410 and symmetrically arranged with respect to the center of the fixing part 410. Thus, the LED module 300 is more firmly mounted on the bottom wall 213 of the cavity 210. Specifically, two pressing plates 471 may be provided.

Figure 4:
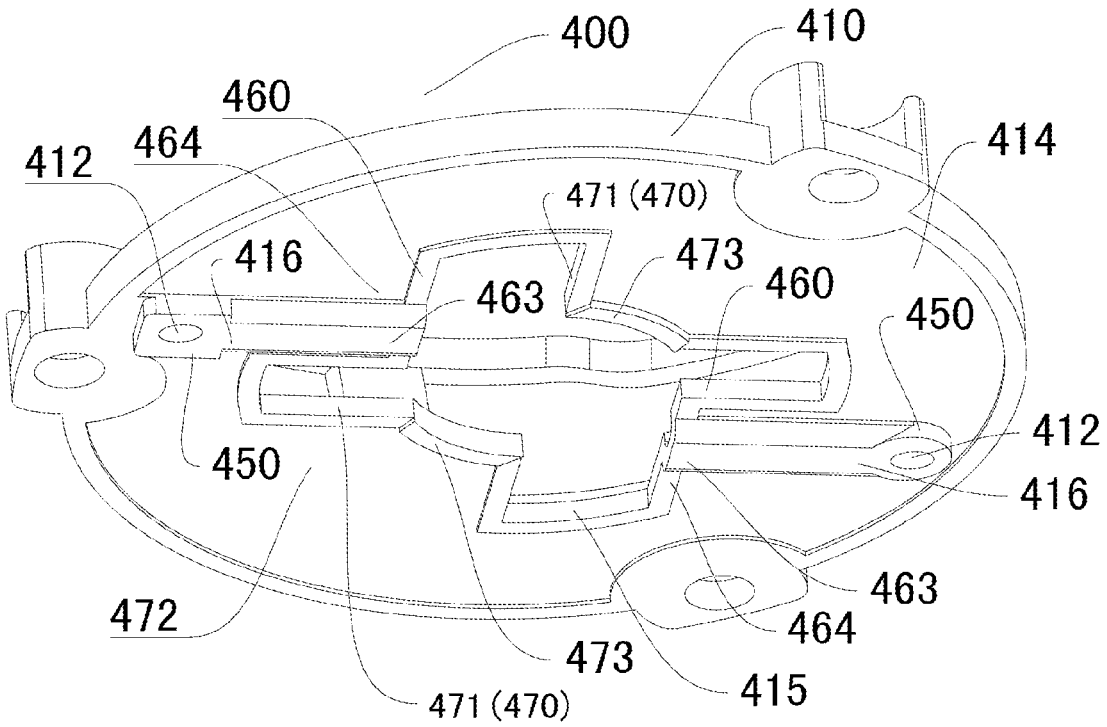
FIG. 4 is a schematic perspective view of a fixing frame of an LED lamp according to an embodiment of the present disclosure.
Figure 7:
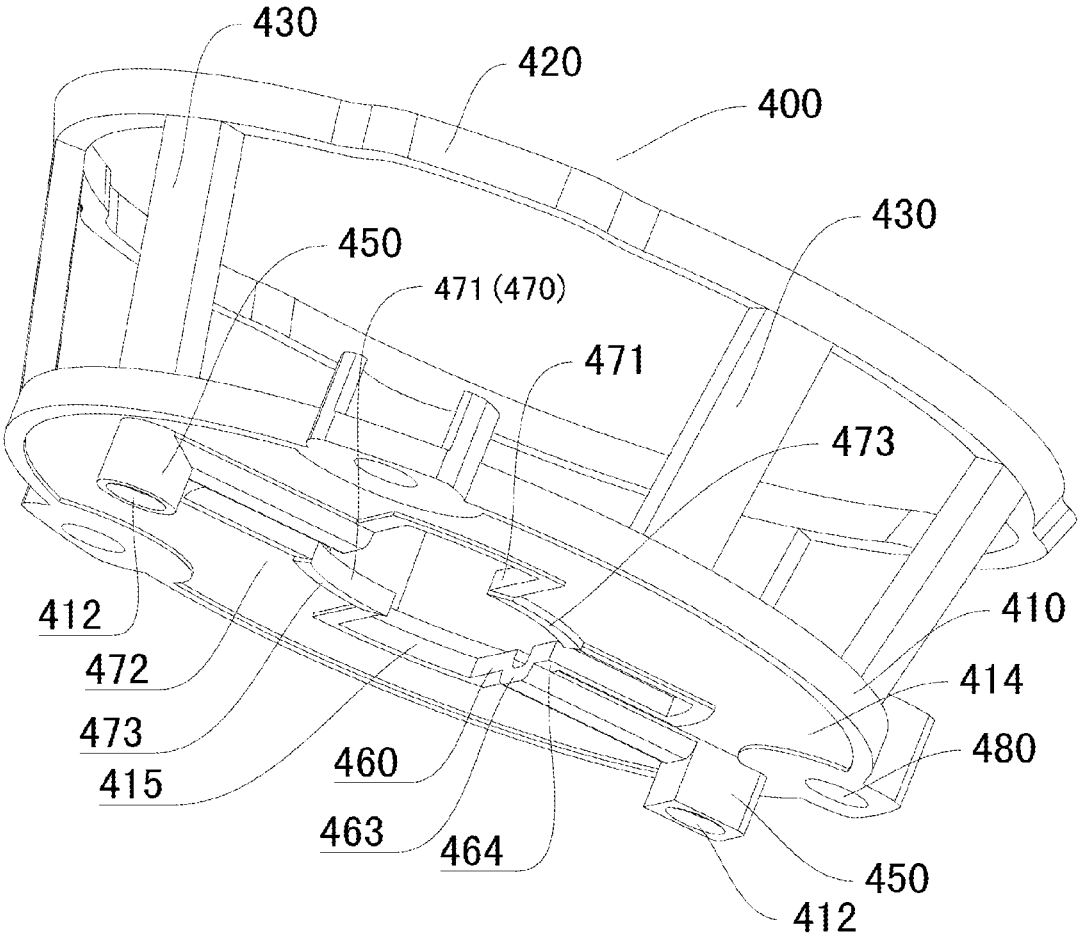
FIG. 7 is a schematic perspective view of a fixing frame of an LED lamp according to another embodiment of the present disclosure.
Figure 8:
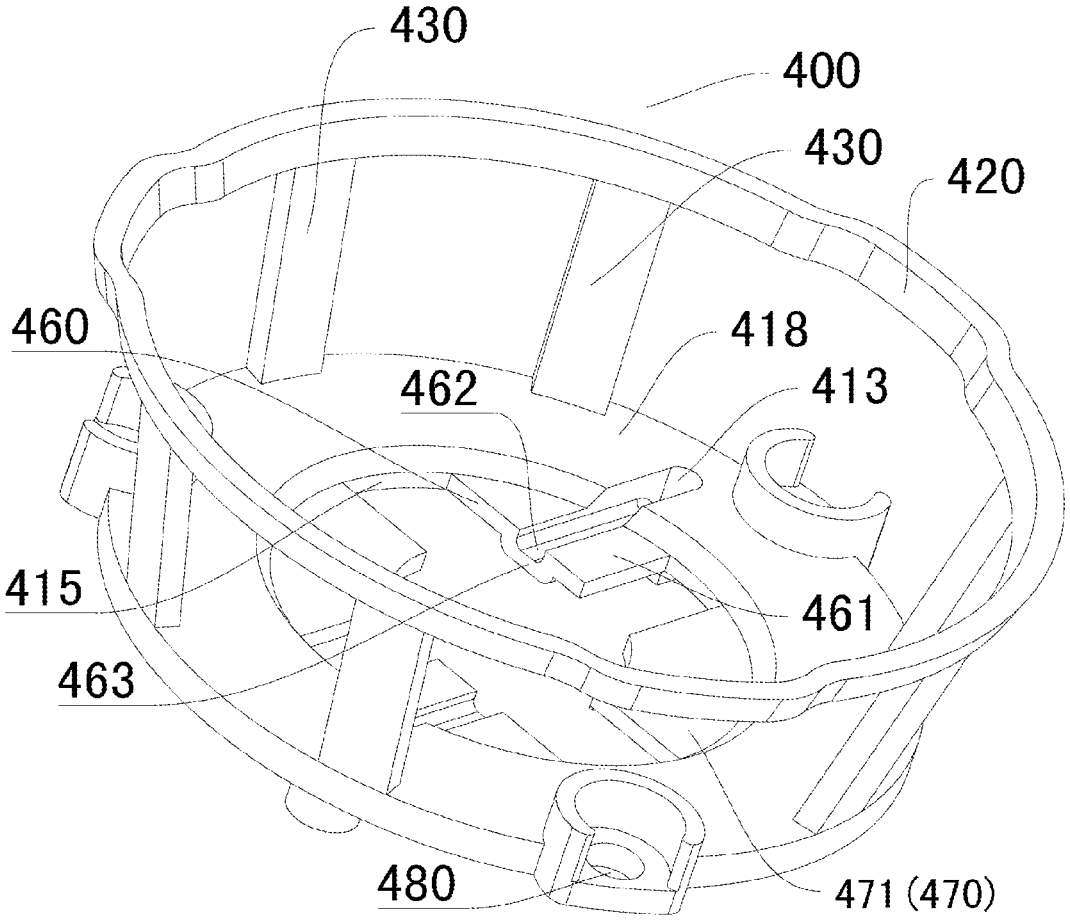
FIG. 8 is a schematic perspective view of a fixing frame of an LED lamp according to another embodiment of the present disclosure.
Figure 9:
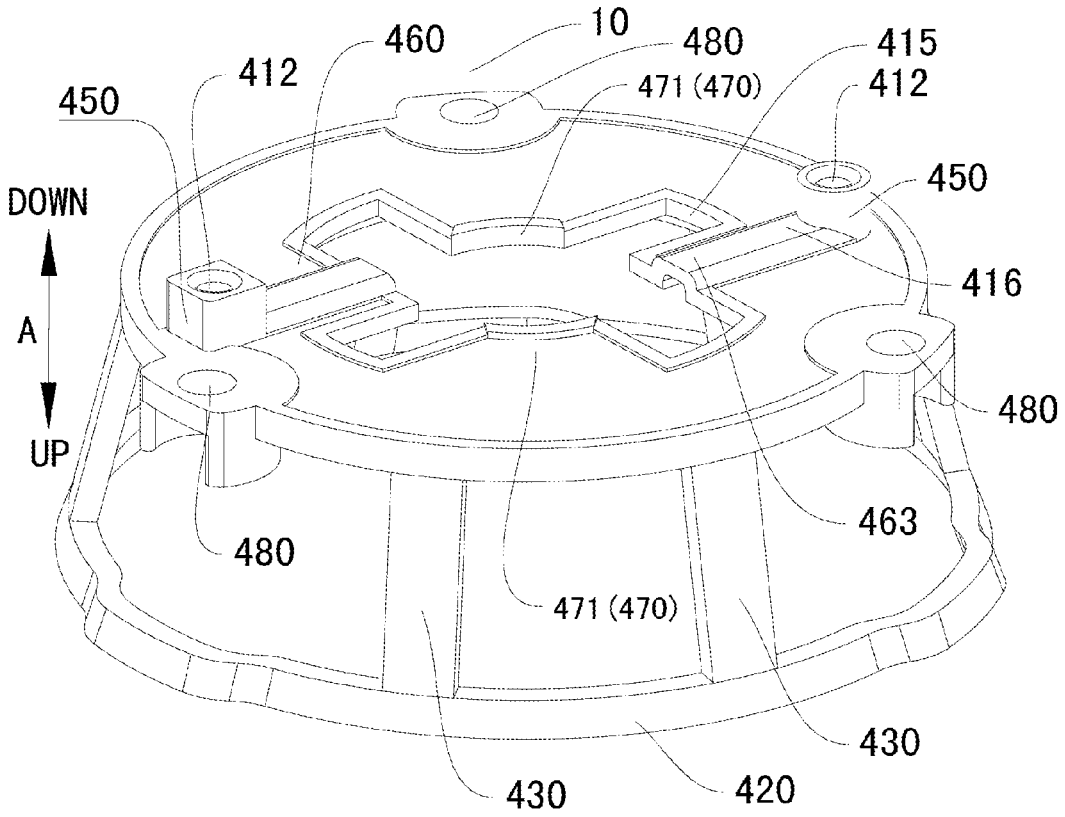
FIG. 9 is a schematic perspective view of a fixing frame of an LED lamp according to another embodiment of the present disclosure.

As shown in FIGS. 4, 7 and 9, advantageously, a protruding rib 473 for pressing the substrate 310 is formed on a lower surface 472 of the pressing part 470. In other words, the protruding rib 473 and the bottom wall 213 of the cavity 210 clamp the substrate 310, i.e. the substrate 310 is disposed between the protruding rib 473 and the bottom wall 213 of the cavity 210. Thus, the LED module 300 is more firmly mounted on the bottom wall 213 of the cavity 210. Moreover, the heat radiation of the LED module 300 is facilitated, therefore the service life of the LED lamp 10 can be further prolonged.

In some embodiments, as shown in FIGS. 6 to 9, the a fixing frame 400 further comprises an upper ring 420 and a plurality of connection rods 430. Each connection rod 430 has an upper end connected with the upper ring 420 and a lower end connected with the fixing part 410. The plurality of connection rods 430 are spaced apart from each other along a circumferential direction of the fixing part 410. Thus, the structure of the a fixing frame 400 is more reasonable.

In some embodiments, the plurality of connection rods 430, the upper ring 420, the fixing part 410 and the pressing part 470 are integrally formed from a plastic material. In other words, the a fixing frame 400 is integrally formed as a plastic part, thus enhancing the structural strength of the a fixing frame 400 and reducing the manufacturing cost of the a fixing frame 400.

As shown in FIGS. 4 and 5, a first wire hole 214 is formed in the bottom wall 213 of the cavity 210 and penetrated therethrough along an up and down direction denoted by arrow A (see FIGS. 2-3, 6 and 9). A second wire hole 412 is formed in the fixing part 410, penetrated therethrough along the up and down direction and corresponded to the first wire hole 214. A first wire groove 413 is formed in an upper surface 418 of the fixing part 410 and has an end communicated with the second wire hole 412.

The heat radiation member 200 is usually made of a metal such as an aluminum alloy, so as to facilitate heat radiation. The most part of the wire is prevented from contacting with the heat radiation member 200 by forming the second wire hole 412 corresponded to the first wire hole 214 and the first wire groove 413 communicated with the second wire hole 412 in the fixing part 410. Thus, a scarfskin of the wire is prevented from deformation and accelerated aging. Therefore, the short circuit caused by the desquamation of the scarfskin of the wire can be avoided, thus improving the service life and security of the LED lamp 10.

In some embodiments, as shown in FIGS. 4, 7 and 9, a column 450 is disposed on a lower surface 414 of the fixing part 410 and fitted within the first wire hole 214, and the second wire hole 412 is penetrated through the column 450. Thus, the most part of the wire is prevented from contacting with the heat radiation member 200, thus improving the service life and security of the LED lamp 10.

As shown in FIGS. 1-2, 4, 6 to 9, in some embodiments, a wire passing extension 460 is disposed on an inner wall 415 of the fixing part 410 and extended towards a center of the fixing part 410. A second wire groove 462 is formed in an upper surface 461 of the wire passing extension 460 and communicated with the first wire groove 413. Thus, the entire wire is prevented from contacting with the heat radiation member 200, thus further improving the service life and security of the LED lamp 10.

In some embodiments, as shown in FIGS. 2, 4, 5, 7 to 9, a first holding groove 211 for receiving the LED module 300 and a second holding groove 212 communicated with the first holding groove 211 are formed in the bottom wall 213 of the cavity 210. A portion of the fixing part 410 is recessed downwardly with respect to a remaining portion of the fixing part 410 so as to form a first boss 416 on a lower surface 414 of the fixing part 410 and to form the first wire groove 413.

A portion of the wire passing extension 460 is recessed downwardly with respect to a remaining portion of the wire passing extension 460 so as to form a second boss 463 on a lower surface 464 of the wire passing extension 460 and to form the second wire groove 462. The first boss 416 and the second boss 463 are received in the second holding groove 212. Thus, a thickness of the fixing part 410 and a thickness of the wire passing extension 460 are not changed, thus ensuring the structural strength of the a fixing frame 400.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. An LED lamp comprising:

a base;

a heat radiation member disposed on the base and defining a cavity therein;

an LED module disposed on a bottom wall of the cavity; and a fixing frame mounted in the cavity so as to press the LED module on the bottom wall of the cavity.

2. The LED lamp of claim 1, wherein the LED module comprises:

a substrate pressed on the bottom wall of the cavity by the a fixing frame;

a patch board disposed on the substrate;

a wire connected with the patch board; and a chip disposed on the substrate and electrically connected to the patch board.

3. The LED lamp of claim 2, wherein the substrate is a ceramic substrate.

4. The LED lamp of claim 2, wherein the a fixing frame presses an outer edge of the substrate.

5. The LED lamp of claim 2, wherein a first holding groove is formed in a bottom wall of the cavity, and the substrate is disposed in the first holding groove.

6. The LED lamp of claim 1, wherein the a fixing frame is detachably fixed on the bottom wall of the cavity by a fastener.

7. The LED lamp of claim 1, wherein the a fixing frame comprises:

a fixing part mounted on the bottom wall of the cavity; and a pressing part connected with the fixing part for pressing the LED module.

8. The LED lamp of claim 7, wherein the fixing part is configured as an annular plate, wherein the pressing part comprises a plurality of pressing plates extended from an inner wall of the fixing part toward a center of the fixing part, spaced apart from each other along a circumferential direction of the fixing part and symmetrically arranged with respect to the center of the fixing part.

9. The LED lamp of claim 7, wherein a protruding rib for pressing the substrate is formed on a lower surface of the pressing part.

10. The LED lamp of claim 7, wherein a first wire hole is formed in the bottom wall of the cavity and penetrated therethrough along an up and down direction, wherein a second wire hole is formed in the fixing part, penetrated therethrough along the up and down direction and corresponded to the first wire hole, wherein a first wire groove is formed in an upper surface of the fixing part and has an end communicated with the second wire hole.

11. The LED lamp of claim 10, wherein a column is disposed on a lower surface of the fixing part and fitted within the first wire hole, and the second wire hole is penetrated through the column.

12. The LED lamp of claim 10, wherein a wire passing extension is disposed on an inner wall of the fixing part and extended towards a center of the fixing part, wherein a second wire groove is formed in an upper surface of the wire passing extension and communicated with the first wire groove.

13. The LED lamp of claim 12, wherein a first holding groove for receiving the LED module and a second holding groove communicated with the first holding groove are formed in the bottom wall of the cavity, a portion of the fixing part is recessed downwardly with respect to a remaining portion of the fixing part so as to form a first boss on a lower surface of the fixing part and to form the first wire groove, a portion of the wire passing extension is recessed downwardly with respect to a remaining portion of the wire passing extension so as to form a second boss on a lower surface of the wire passing extension and to form the second wire groove, wherein the first boss and the second boss are received in the second holding groove.

14. The LED lamp of claim 12, wherein the a fixing frame further comprises:

an upper ring;

a plurality of connection rods, each defining an upper end connected with the upper ring and a lower end connected with the fixing part, the plurality of connection rods being spaced apart from each other along a circumferential direction of the fixing part.

15. The LED lamp of claim 14, wherein the plurality of connection rods, the upper ring, the fixing part and the pressing part are integrally formed from a plastic material.

* * * * *